US006213836B1

(12) United States Patent
Nagata et al.

(10) Patent No.: US 6,213,836 B1
(45) Date of Patent: Apr. 10, 2001

(54) CATHODE RAY TUBE AND METHOD FOR MANUFACTURING THE SAME

(75) Inventors: Keiji Nagata; Masanori Morii, both of Osaka; Toshio Ishii; Tadashi Muramoto, both of Hyogo, all of (JP)

(73) Assignees: Matsushita Electronics Corporation, Osaka; Muramoto Industry Co., Ltd., Hyogo, both of (JP)

( * ) Notice: Subject to any disclaimer, the term of this patent is extended or adjusted under 35 U.S.C. 154(b) by 0 days.

(21) Appl. No.: 09/412,664

(22) Filed: Oct. 5, 1999

Related U.S. Application Data

(62) Division of application No. 08/984,890, filed on Dec. 4, 1997.

(30) Foreign Application Priority Data

Dec. 13, 1996 (JP) ..... 8-333219

(51) Int. Cl.[7] ..... H01J 29/80
(52) U.S. Cl. ..... 445/23; 313/407; 313/402
(58) Field of Search ..... 313/402–408, 313/479; 445/23, 24, 30, 37, 45, 47

(56) References Cited

U.S. PATENT DOCUMENTS 3,821,583 * 6/1974 Steiner ..... 313/407
3,962,598 * 6/1976 Schneider, Jr. ..... 313/406
5,126,624 * 6/1992 Ji ..... 313/402
5,355,049 * 10/1994 Sung ..... 313/402
5,469,016 * 11/1995 Chum ..... 313/402
5,986,393 * 11/1999 Nagata et al. ..... 313/407
6,104,132 * 8/2000 Nose et al. ..... 313/402

FOREIGN PATENT DOCUMENTS 5-151908 6/1993 (JP) .
9-17347 1/1997 (JP) .

* cited by examiner

*Primary Examiner*—Kenneth J. Ramsey
*Assistant Examiner*—Matthew J. Gerike
(74) *Attorney, Agent, or Firm*—Merchant & Gould P.C.

(57) ABSTRACT

The present invention relates to a cathode ray tube having an inner magnetic shield and to a method for fixing the inner magnetic shield. The inner magnetic shield is fixed to a frame supporting a shadow mask simply with fixing members. First engagement holes are provided on each side of a first flange portion of the frame, and second engagement holes are provided on each side of a second flange portion of the inner magnetic shield. Each side of the second engagement hole is provided with a folding portion. The fixing member is inserted so as to put into the first engagement hole and the second engagement hole facing the first engagement hole from the side of the inner magnetic shield.

3 Claims, 5 Drawing Sheets

CATHODE RAY TUBE AND METHOD FOR MANUFACTURING THE SAME

This application is a Divisional of application Ser. No. 08/984,890, filed Dec. 4, 1997, which application(s) are incorporated herein by reference.

FIELD OF THE INVENTION

The present invention relates to a cathode ray tube that irradiates an electron beam utilizing high voltage and to a method for manufacturing the same. More particularly, the present invention relates to a cathode ray tube having an inner magnetic shield and to a method for fixing the inner magnetic shield to the cathode ray tube.

BACKGROUND OF THE INVENTION

In order to improve pressure-resistant characteristics and to prevent electric discharges caused by a foreign material produced by welding sparks in fixing an inner magnetic shield to a frame (a shadow mask frame) of a cathode ray tube by welding, a method for fixing an inner magnetic shield to a frame using spring fixing members (hereafter referred to as fixing members) has been proposed as disclosed, for example, in Japanese laid-open patent application (Tokkai Hei) 5-151908.

That is, the frame and the inner magnetic shield have a first and a second flange portion projecting in the direction crossing the tube axis of the cathode ray tube at right angles, respectively. About 10 engagement holes whose diameter is 10 mm or less are provided on each side of the first and second flange portions. Generally Ω-shaped fixing members are firmly fit into the engagement holes, thereby fixing the inner magnetic shield to the frame by utilizing spring elasticity. According to this method, since the inner magnetic shield can be fixed without welding, electric discharges caused by a foreign material produced by welding sparks can be prevented.

Conventionally, in consideration of mass-productivity, etc., an inner magnetic shield has been manufactured by punching a sheet by a press. In the case of the press working, burrs are produced on an end face of a part being punched in punching a sheet. Generally, the material for a fixing member is harder than that for an inner magnetic shield. Therefore, burrs on an end face of an engagement hole on an inner magnetic shield drop off when a fixing member comes into contact with the end face of the engagement hole in fitting the fixing member into the engagement hole in order to fix an inner magnetic shield to a frame.

When burrs that are metal scraps drop off, the burrs are caught in the openings of a shadow mask and the openings may be closed. Even if the burrs are not directly caught in the openings of the shadow mask, the burrs may intrude into a slight space between the shadow mask and the frame. The burrs may be come out from the space between the shadow mask and the frame by vibration, impact or the like in the subsequent steps such as, for example, a frit seal process wherein a panel and a funnel are glued, a sealing process wherein an electron gun is installed, an evacuation process wherein a valve is evacuated, and the like. Then, the burrs may be caught in the openings of the shadow mask. When the burrs are caught in the openings of the shadow mask, which causes the openings of the shadow mask to be closed, an electron beam is shielded and the fluorescent substance of the screen does not emit light. That is to say, it causes a picture defect.

In collecting and analyzing the foreign materials that had closed the openings of the shadow mask, about 30% of the foreign materials were burrs that were metal foreign materials. In order to remove burrs, for example, a blasting treatment, chemical polishing, electrolytic polishing and the like have been carried out, since it is not possible to prevent the production of burrs in the press working. In the case of the blasting treatment, there is a problem that an inner magnetic shield is deformed by putting the polishing material on the inner magnetic shield at high pressure. In case of chemical polishing, electrolytic polishing or the like, the processes such as washing, neutralization, washing, etc. are needed after the polishing treatment. If these processes after the polishing are not carried out properly, in the blackening film treatment, which is a surface treatment of the inner magnetic shield carried out in a subsequent process, a nonuniform film in quality may be obtained, the film may drop off or the like. Moreover, many processes for these treatments are needed, which causes cost increases.

SUMMARY OF THE INVENTION

In order to solve the problems mentioned above in the prior art, it is an object of the present invention to provide a cathode ray tube wherein an inner magnetic shield is simply fixed to a frame supporting a shadow mask with fixing members capable of preventing burrs from dropping at the time of fitting the fixing members firmly into the engagement holes provided on the frame and the inner magnetic shield, and a method for manufacturing the same.

In order to achieve the object mentioned above, the cathode ray tube of the present invention comprises: (1) a shadow mask having a plurality of predetermined-shape openings arranged in a predetermined pattern; (2) a frame supporting the shadow mask, which has a first flange portion formed in a direction crossing the tube axis of the cathode ray tube almost at a right angle and a plurality of first engagement holes formed on the first flange portion; (3) an inner magnetic shield fixed to the frame, which has a second flange portion formed in the direction crossing the tube axis of the cathode ray tube almost at a right angle and a plurality of second engagement holes that are formed on the second flange portion and are facing a corresponding first engagement hole of the first flange portion; and (4) a plurality of fixing members fixing the inner magnetic shield to the frame by putting and fitting into the first engagement holes and second engagement holes that are facing each other. In the cathode ray tube mentioned above, at least a part of an end face of the second engagement hole on the inner magnetic shield, where the fixing member slides, is folded back.

In the construction of the cathode ray tube according to the present invention, it is preferable that the width of the folded portion on an end face of the second engagement hole on the inner magnetic shield is 1.0 mm or less.

In the construction of the cathode ray tube according to the present invention, it is preferable that the shape of the first engagement holes on the frame and of the second engagement holes on the inner magnetic shield is one selected from a substantially rectangular shape, a substantially circular shape or a substantially elliptical shape.

The method for manufacturing the cathode ray tube of the present invention is a method for manufacturing the cathode ray tube comprising: (1) a shadow mask having a plurality of predetermined-shape openings arranged in a predetermined pattern; (2) a frame supporting the shadow mask; and (3) an inner magnetic shield fixed in the frame. In the method for manufacturing the cathode ray tube, a plurality of first and second engagement holes facing each other are provided on the first and second flange portions of the frame and of the inner magnetic shield, which are formed in a direction crossing the tube axis of the cathode ray tube almost at a right angle, and at least a part of an end face of the second engagement hole on the inner magnetic shield, where the fixing member slides, is folded back. Then, the fixing members are put and fit into each of the facing first and second engagement holes, thereby fixing the inner magnetic shield to the frame.

In the method for manufacturing the cathode ray tube according to the present invention, it is preferable that the width of the folding portion on an end face of the second engagement hole on the inner magnetic shield is 1.0 mm or less.

In the method for manufacturing the cathode ray tube according to the present invention, it is preferable that the shape of the first engagement holes on the frame and of the second engagement holes on the inner magnetic shield is one selected from a substantially rectangular shape, a substantially circular shape or a substantially elliptical shape.

According to the construction of the cathode ray tube according to the present invention and the method for manufacturing the same, the fixing members slide on the smooth surface having no burrs, wherein the end face of the second engagement hole on the inner magnetic shield is folded back, when the fixing members are fit into the first and second engagement holes provided on the frame and on the inner magnetic shield. Accordingly, the fixing member does not come into contact with burrs and the burrs therefore do not drop. As a result, the closure of openings on the shadow mask by burrs being dropped off can be prevented along with any short circuit between the electrodes of the electron gun. Thus, a favorable effect, i.e. improving the quality of the cathode ray tube, can be obtained. In folding by press working, the excellent adherence can be obtained by making the width of the folding portion in each side of the engagement hole 1.0 mm or less. As a result, no space is provided behind the part folded back, which can prevent the intrusion of foreign materials into the part folded back. Furthermore, the process for folding back the end face of the engagement hole can be easily carried out and it is possible to correspond to various shapes of fixing members, since the shape of the first engagement hole on the frame and of the second engagement hole on the inner magnetic shield is one selected from a substantially rectangular shape, a substantially circular shape or a substantially elliptical shape.

DETAILED DESCRIPTION OF PREFERRED EMBODIMENT

Figure 1:
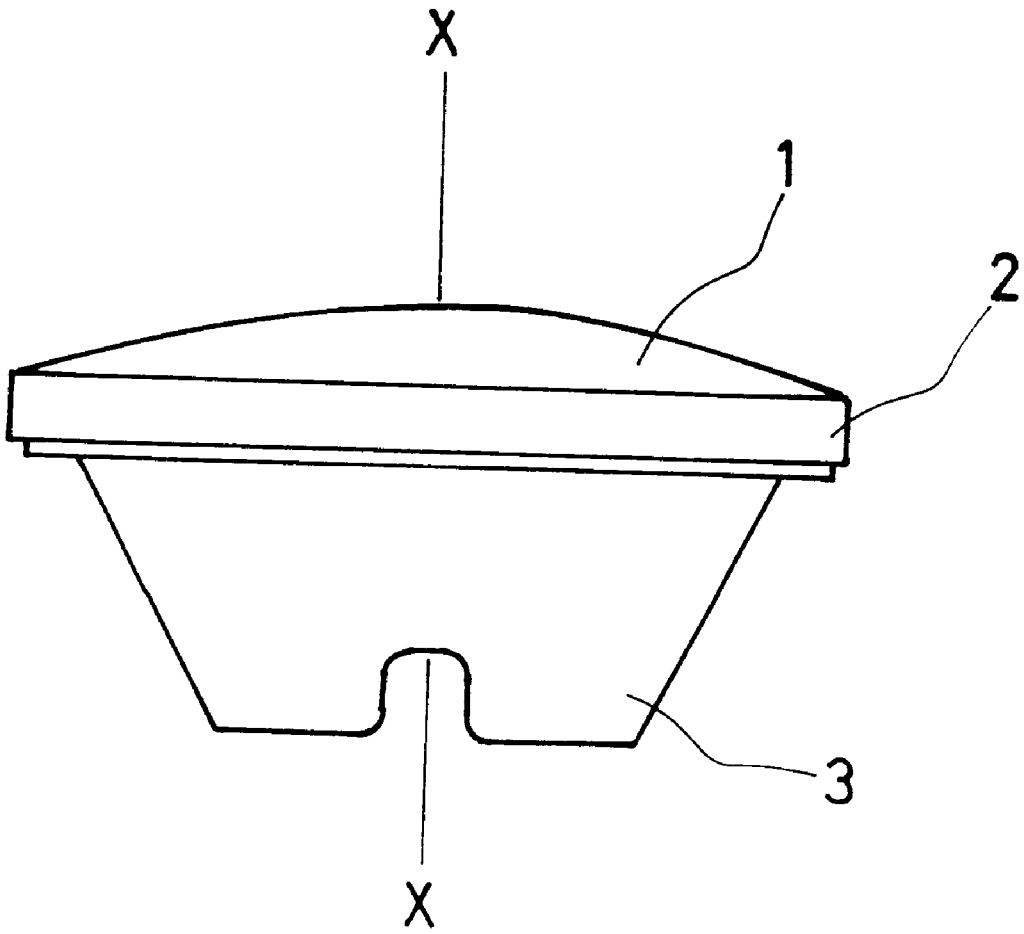
FIG. 1 is a side view illustrating the assembled construction of a shadow mask, a frame and an inner magnetic shield in one embodiment of a cathode ray tube according to the present invention.
Figure 2:
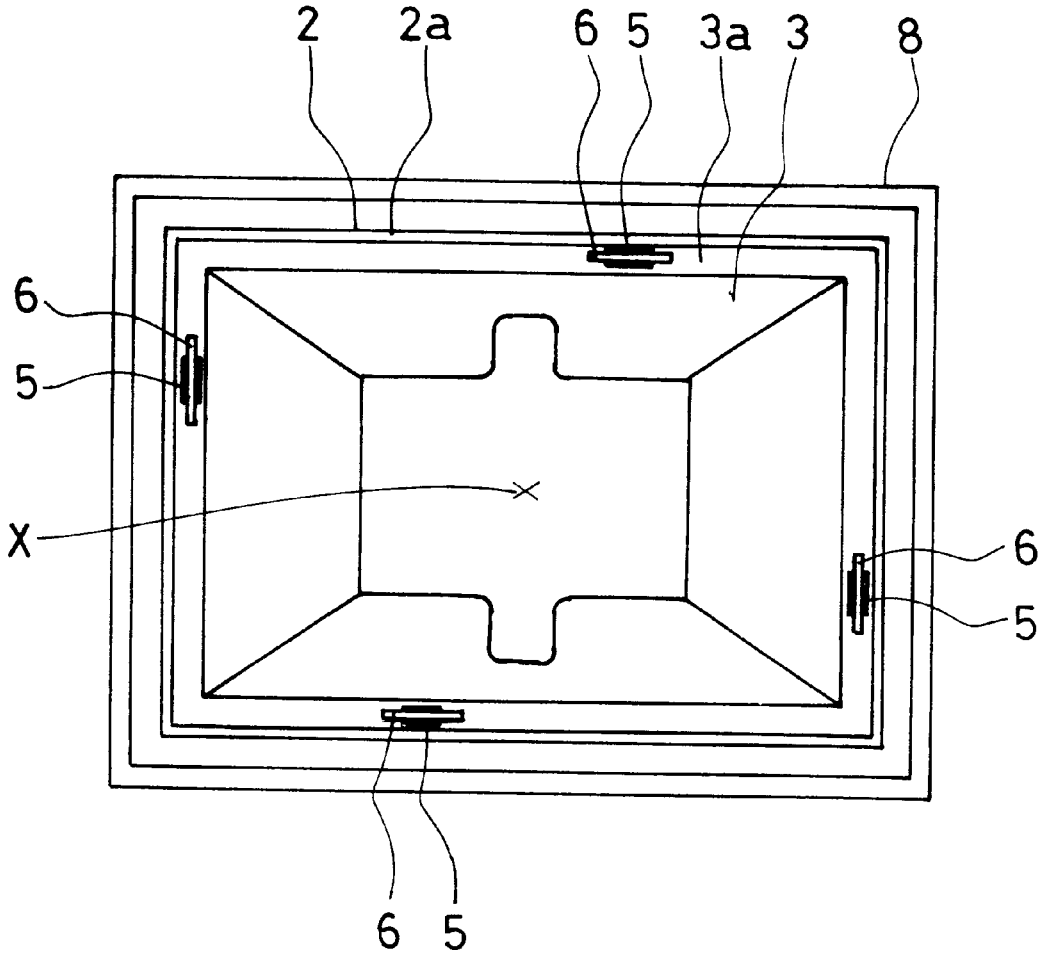
FIG. 2 is a bottom view illustrating the assembled construction of a shadow mask, a frame and an inner magnetic shield, which are unified with a panel, in one embodiment of a cathode ray tube according to the present invention.

One preferable embodiment of a cathode ray tube according to the present invention and of a method for manufacturing the same will be described referring to FIG. 1–5 as follows. FIG. 1 is a side view illustrating the assembled construction of a shadow mask 1, a frame 2 supporting the shadow mask (a shadow mask frame) and an inner magnetic shield 3 in the cathode ray tube of the present embodiment. FIG. 2 is a bottom view illustrating the assembled construction of the shadow mask 1, the frame 2 and the inner magnetic shield 3, which are unified with a panel 8, in the cathode ray tube of the present embodiment. As shown in FIGS. 1 and 2, the frame 2 and the inner magnetic shield 3 have respective first and a second flange portions 2*a* and 3*a* projecting to the direction crossing the tube axis X at a right angle. The second flange portion 3*a* of the inner magnetic shield 3 is fixed to the first flange portion 2*a* of the frame 2 with a plurality of fixing members 6.

The shadow mask 1 is formed into the predetermined shape by a press working and the like after providing openings such as circle, slit, slot, etc. (for example, a diameter of a circular opening is about 110 $\mu$m) in a sheet (for example, having thickness of 0.13 mm) by an etching process or the like. For example, an invar material (36%: Ni and the rest: Fe), an Fe material and the like are used as a material for the shadow mask 1. The frame 2 supporting the shadow mask 1 is manufactured, for example, by pressing a Fe material, and its thickness is, for example, 1.4 mm. The inner magnetic shield 3 is manufactured, for example, by pressing a Fe material having a thickness of 0.13 mm.

Figure 3:
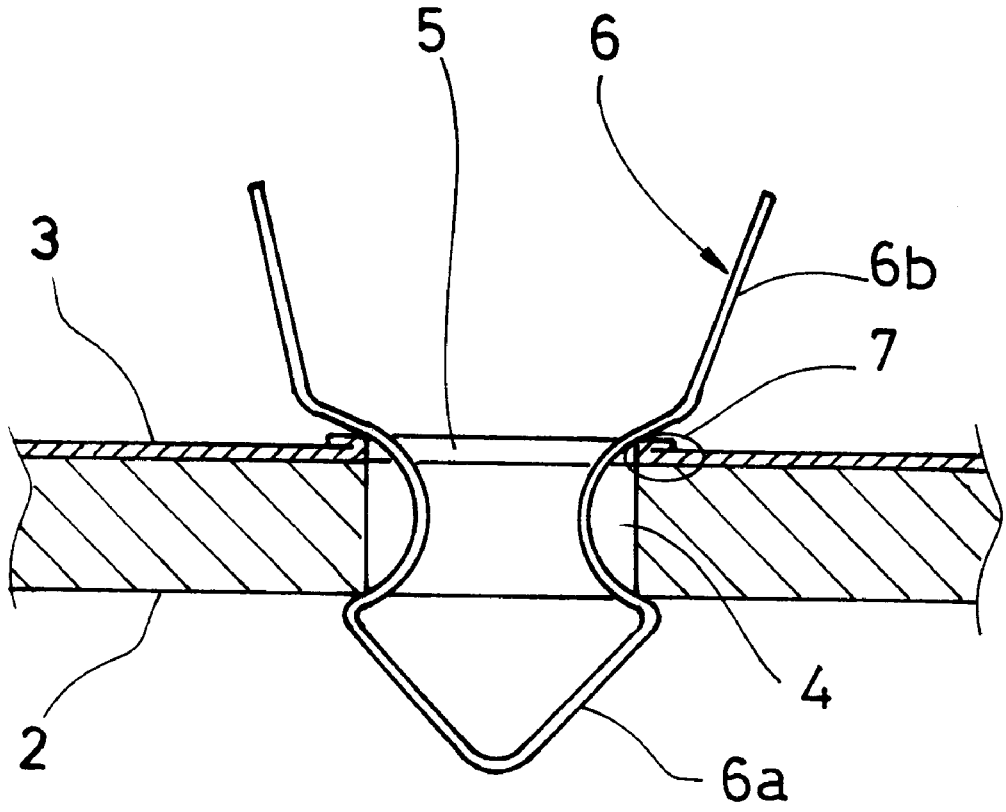
FIG. 3 is an enlarged partial cross sectional view illustrating a method for fixing an inner magnetic shield to a frame with fixing members in one embodiment of the present invention.

The constitution of the part wherein the frame 2 and the inner magnetic shield 3 are installed is described in detail referring to FIG. 2 and FIG. 3. As shown in FIGS. 2 and 3, first engagement holes 4 are provided on each side of the first flange portion 2*a* of the frame 2. In order to correspond to each of the first engagement holes 4 provided on each side of the first flange portion 2*a* of the frame 2, the same number of second engagement holes 5 are provided on each side of the second flange portion 3*a* of the inner magnetic shield 3. The fixing members 6 are inserted so as to put into the first engagement holes 4 on the frame 2 and the second engagement holes 5 on the inner magnetic shield 3 facing the first engagement holes 4. Thus the inner magnetic shield 3 is fixed to the frame 2 by utilizing the spring elasticity of the fixing members. As shown in FIG. 3, the fixing member 6 is made of a ribbon-shape material having elasticity, which has been bent to be an almost symmetrical shape. The fixing member 6 comprises an anchor portion 6*a,* which engages the first engagement hole 4 and the second engagement hole 5 and also which makes the fixing member 6 difficult to slip off, and a pair of bent members 6*b* for generating elasticity. When it is seen from the direction shown in FIG. 2, the first engagement hole 4 on the frame 2 and the second engagement hole 5 on the inner magnetic shield 3 have a substantially rectangle-shape in order to engage with the fixing member 6.

Figure 4:
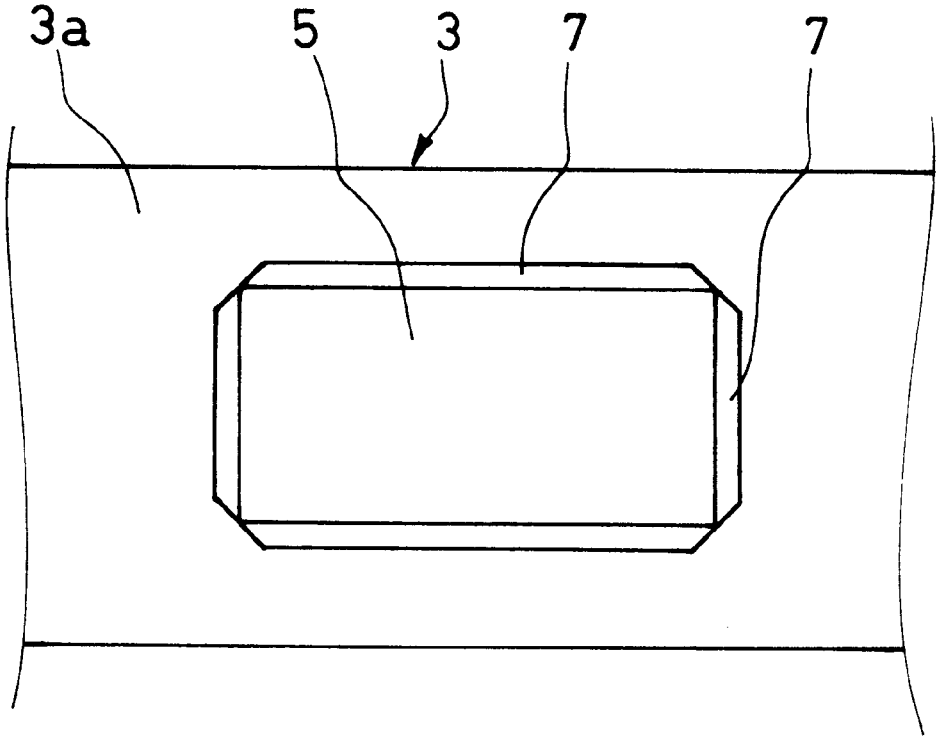
FIG. 4 is an enlarged partial plan view illustrating a second engagement portion provided on an inner magnetic shield in one embodiment of a cathode ray tube according to the present invention.

As shown in FIGS. 3 and 4, each side of the second engagement hole 5 on the inner magnetic shield 3 is provided with a folding portion 7. That is, there is no burr on the contact surface between the fixing member 6 and the second engagement hole 5. Consequently, the occurrence of burrs that are metal foreign materials that can be caught in the openings of a shadow mask and that can adhere between electrodes of an electron gun can be prevented. Especially, the folding portion 7 can be adhered to the surface of the inner magnet shield 3 so as to create no space by making the width of the folding portion 7 1.0 mm or less. Consequently, foreign materials intrude behind the folding portion 7 can be prevented.

EXAMPLE

An example of the cathode ray tube according to the present invention and the method for manufacturing the same will be described using concrete values as follows. The description is made by using an example of an inner magnetic shield used in a 41 cm CMT (Color Monitor Tube). The shadow mask 1 was made of a sheet having a thickness of 0.13 mm and was provided with a number of circular openings whose diameter was about 110 $\mu$m by an etching process. In view of thermal expansion, an invar material (36%: Ni and the rest: Fe) that is a low expansion material is used as a material of the shadow mask 3. In view of cost considerations, Fe material or the like is used as a material of the shadow mask 3. The thin plate made of such materials was formed into the shape shown in FIG. 1 by press working.

The frame 2 was formed from a Fe material (aluminum killed steel) having a thickness of 1.4 mm by press working. Lots of roll-off occur on the one surface at the time of punching by press working resulting in creating no burr, since the frame 2 has a thickness of 1.4 mm, which is thick. However, burrs occur on another surface. Therefore, the surface having burrs is processed by pressing the whole surface in order to prevent the occurrence of burrs.

The inner magnetic shield 3 was formed into the shape shown in FIG. 1 and in FIG. 2 by pressing a Fe based material having a thickness of 0.13 mm. The thin material in thickness does not enable the process by pressing the surface having burrs to be carried out. After the press forming, a blackening film treatment was carried out on the whole surface of the inner magnetic shield 3 in order to prevent halation. The hardness of the material improves to around Hv175 by this treatment. Further, the fixing member 6 was made, for example, by bending a ribbon-shape sheet (SUS 631) having a thickness of 0.4 mm into a predetermined shape and then carrying out the precipitation hardening treatment, resulting in the material having a hardness of around Hv470.

The shadow mask 1 and the frame 2 were assembled using a method of welding or the like. Then, as shown in FIG. 2, a spring (not shown in the figure) fixed on the frame 2 and a stud pin (not shown in the figure) fixed on the panel 8 were firmly fit, resulting in an assembly unifying the shadow mask 1 and the frame 2 with the panel 8. As a next step, the inner magnetic shield 3 for shielding magnetism was fit in the frame 2 that had been fit in the panel 8 together with the shadow mask 1.

The frame 2 and the inner magnetic shield 3 were combined by matching the position of the first engagement hole 4 on the frame 2 and of the second engagement hole 5 on the inner magnetic shield 3 and then by inserting the anchor portion 6*a* of the fixing member 6 from the side of the inner magnetic shield 3 into the matched engagement holes 5 and 4. As shown in FIG. 3, the maximum width of the anchor portion 6*a* of the fixing member 6 is wider than that of the first engagement hole 4 on the frame 2 and of the second engagement hole 5 on the inner magnetic shield 3. That is, the fixing member 6 is constituted so as not to slip off easily, once the anchor portion 6*a* is fit into the first engagement hole 4 and the second engagement hole 5. Furthermore, the inner magnetic shield 3 was fixed tightly on the frame 2, since the bent members 6*b* of the fixing member 6 press the inner magnetic shield 3 in the direction of the frame 2. Moreover, the relative position of the frame 2 and the inner magnetic shield 3 is not easily shifted, since the fixing members 6 are provided on each side of the first flange portion 2*a* on the frame 2 and of the second flange portion 3*a* on the inner magnetic shield 3.

As shown in FIG. 4, the second engagement hole 5 on the inner magnetic shield 3 has a substantially rectangular shape and the folding portion 7 on each side. That is to say, the end face of the second engagement hole 5 on the inner magnetic shield 3 does not have a surface being punched by press working, on which burrs are present, but a smooth bent surface on which no burrs are present. Consequently, when the anchor portion 6*a* of the fixing member 6 is fit into the first engagement hole 4 and the second engagement hole 5, the surface of the anchor portion 6*a* of the fixing member 6 and the end face of the second engagement hole 5 on the inner magnetic shield 3 contact each other and slide, but the dropping of burrs by the fixing member 6 does not occur. As a result, the closing of openings of the shadow mask 1 by dropping of burrs can be prevented. Therefore, a failure of a fluorescent substance to emit light due to shielding of an electron beam, i.e. a picture defect, does not occur.

Figure 5:
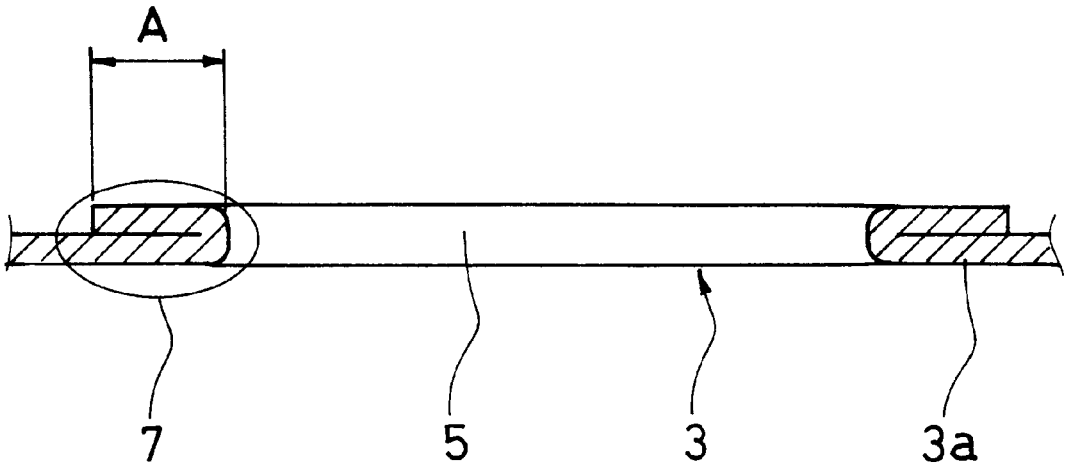
FIG. 5 is an enlarged partial cross sectional view illustrating a second engagement portion provided on an inner magnetic shield in one embodiment of a cathode ray tube according to the present invention.

Especially, as shown in FIG. 5, the folding portion 7 can be adhered to the surface of the inner magnetic shield 3 so as to create no space by making the width A of the folding portion 7 of the second engagement hole 5 on the inner magnetic shield 3 1.0 mm or less. If the width of the folding portion 7 is wider, space is created in the folding portion 7, i.e. there may be a possibility of intrusion of foreign materials such as burrs and the like into the space.

Following is the result of a test. In the test results using the inner magnetic shield of the present invention, 30% of the total number of defects in the prior art, i.e. the defects from the openings of the shadow mask being closed, were avoided. Furthermore, regarding the short circuit failure caused by the adherence of foreign materials between the electrodes of the electron gun, 27% of these failures in the prior art were prevented.

In the embodiment mentioned above, the folding portion 7 of the second engagement hole 5 on the inner magnetic shield 3 is formed on the side from where the fixing member 6 is inserted. However, the same effect may be obtained in case of forming the folding portion 7 on the side of the frame 2. In addition, the shape of the first engagement hole 4 and the second engagement hole 5 should not be limited to a rectangular shape that is used in the embodiment mentioned above. The same effect may be obtained when using a circular or elliptical shape.

The invention may be embodied in other specific forms without departing from the spirit or essential characteristics thereof the embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A method for manufacturing a cathode ray tube comprising a shadow mask having a plurality of predetermined-shaped openings arranged in a predetermined pattern, a frame supporting the shadow mask and an inner magnetic shield fixed to the frame, comprising;

a step of providing a plurality of first and second engagement holes facing each other on a first flange portion and a second flange portion of the frame and of the inner magnetic shield respectively, the flange portions being formed in a direction crossing the tube axis of the cathode ray tube substantially at a right angle;

a step of folding back at least a part of an end face of the second engagement hole on the inner magnetic shield; and a step of putting and fitting fixing members into each of the facing first and second engagement holes, thereby fixing the inner magnetic shield to the frame, wherein a folded back portion of the end face includes the portion engaged by the fixing member.

2. The method for manufacturing a cathode ray tube according to claim 1, wherein the width of the folding portion on an end face of the second engagement hole on the inner magnetic shield is 1.0 mm or less.

3. The cathode ray tube according to claim 1, wherein the shape of the first engagement holes on the frame and of the second engagement holes on the inner magnetic shield is one selected from a substantially rectangular shape, a substantially circular shape or a substantially elliptical shape.

* * * * *